United States Patent [19]

Frederick et al.

[11] Patent Number: 4,615,070

[45] Date of Patent: Oct. 7, 1986

[54] SWEEPER WITH SPEED CONTROL FOR BRUSH AND VACUUM FAN

[75] Inventors: Sherman B. Frederick, Minneapolis; Charles E. Grimes, Bloomington; Paul W. Kimzey, St. Louis Park, all of Minn.

[73] Assignee: Tennant Company, Minneapolis, Minn.

[21] Appl. No.: 644,857

[22] Filed: Aug. 27, 1984

[51] Int. Cl.[4] ..... E01H 1/04

[52] U.S. Cl. ..... 15/339; 15/83; 15/349

[58] Field of Search ..... 15/340, 349, 83, 339

[56] References Cited

U.S. PATENT DOCUMENTS

| | | | |
|---|---|---|---|
| 3,619,850 | 11/1971 | Rideout et al. | 15/323 |
| 3,691,579 | 9/1972 | Kasper | 15/340 X |
| 3,695,006 | 10/1972 | Valbona et al. | 55/274 |
| 3,931,662 | 1/1976 | Nayfa et al. | 15/320 |
| 4,138,756 | 2/1979 | Krier et al. | 15/83 |
| 4,206,530 | 6/1980 | Kroll et al. | 15/340 |
| 4,317,246 | 3/1982 | Knowlton | 15/83 |

OTHER PUBLICATIONS

Bulletin entitled "250 Power Sweeper" of the Tennant Company, Copyright 1981.

Bulletin entitled "95, 95AA" of the Tennant Company, c. 1983.

Bulletin entitled "360" of the Tennant Company showing Model 360, c. 1984.

*Primary Examiner*—Chris K. Moore

*Attorney, Agent, or Firm*—Kinzer, Plyer, Dorn & McEachran

[57] ABSTRACT

This invention is concerned with a sweeper, meaning a sweeper with a rotary main brush opposite a hopper, and increasing its ability to load light debris, such as paper, dry leaves and the like so that light debris will be propelled farther into the debris hopper. This is done by setting the speed of the main brush at a lower speed for normal operation to effectively throw what may be thought of as heavier material, such as sand, forwardly into the hopper with the speed being such that excessive wear of the brush is avoided and a higher speed of rotation being effected from time to time so that paper, dry leaves and the like, which may be considered lightweight material, are thrown farther into the hopper with the increased speed of the main brush overcoming the air resistance that normally stops such lightweight material which, at normal operation of the brush, tends to pile up in the rear of the hopper. The sweeper uses a vacuum fan to create a suction in the hopper with the vacuum fan also being speeded up with the brush speed increase which assists in loading the lightweight debris in the hopper. Since the increased speed is used for the main brush and vacuum fan only from time to time when light debris is encountered and on a limited basis, the increased brush wear and power consumption caused thereby is tolerable.

27 Claims, 6 Drawing Figures

SWEEPER WITH SPEED CONTROL FOR BRUSH AND VACUUM FAN

SUMMARY OF THE INVENTION

This invention is concerned with a sweeper which is a surface cleaning or surface maintenance machine and may be of the self-propelled type meaning that it has wheels which may be power-driven. The sweeper has a main brush which is generally horizontally disposed and power-driven and is positioned opposite a hopper which has a rear opening opposite the brush to receive material which is swept up and thrown forward by the brush into the hopper, normally referred to as a direct throw sweeper. Such a unit normally has a vacuum fan connected to the hopper tending to create a vacuum therein which draws air in under and around the sides of the sweeper, for example, the side skirts to hold in the dust that is created by the brush which is objectionable if it escapes from the machine.

A primary object of the invention is a sweeper of this general type which effectively provides for the loading of light material such as paper, dry leaves and the like with a minimum of alteration of the basic structure of the machine.

Another object is a machine of the above type which increases the speed of rotation of the brush when light debris is encountered so that lightweight material will be thrown farther into the hopper.

Another object is an arrangement for increasing the speed of the vacuum fan with the increase in speed of the brush to assist in drawing the lightweight material farther into the hopper.

Another object is a hydraulically operated sweeper of the above type which uses one circuit for driving the brush and vacuum fan so that their speed may be varied and another circuit for driving a side brush which is normally used to move material from alongside the sweeper into the path of the main brush with the speed of the side brush not being increased when the speed of the main brush and vacuum fan are increased.

Another object is a sweeper of the above type which does not create or have brush wear problems.

Another object is a sweeper of the above type which has a disk type side brush or gutter brush, the speed of which is not increased when the main brush and/or vacuum fan speeds are increased.

Another object is a hydraulic system for a sweeper of the above type which uses a main circuit for operating the main brush and exhaust fan and a separate circuit for the side brush.

Another object is a speed control arrangement which enables a direct throw sweeper to load light debris effectively.

Another object is a direct throw sweeper which has a speed control for the sweeping brush and vacuum fan which is constructed and arranged to give acceptable brush life with effective light debris loading.

Another object is a sweeper of the above type which may be either a low dump or a high dump unit.

Another object is a sweeper of the above type with effective light debris loading without major added components.

Another object is a sweeper of the above type which effects light debris loading at much lower costs than prior devices.

Another object is a sweeper of the above type which may be powered by a gasoline, LP or diesel engine as well as a battery powered unit.

Another object is a unit of the above type in which the main brush and side brush are hydraulically operated and the vacuum fan is driven by a belt from the engine.

Another object is a sweeper of the above type in which the main brush and vacuum fan are belt driven by the engine and the side brush is driven by an electric motor.

Another object is a sweeper of the above type which is entirely battery powered.

Another object is a unit of the above type which can operate much of the time at lower noise levels, lower emission level and lower fuel consumption.

Another object is a unit of the above type which with its high speed, brush and possibly more air movement can sweep difficult-to-sweep debris, such as long pine needles, tobacco leaves and the like, better than a normal speed brush.

Another object is a unit of the above type which, because of its high speed brush, allows for sweeping at higher travel speeds, for example, up to 10 miles per hour, where the surroundings allow it, such as patrol sweeping of parking lots which normally have only scattered light debris.

Other objects will appear from time to time in the ensuing specification and drawings.

DESCRIPTION OF THE PREFERRED EMBODIMENT

Figure 1:
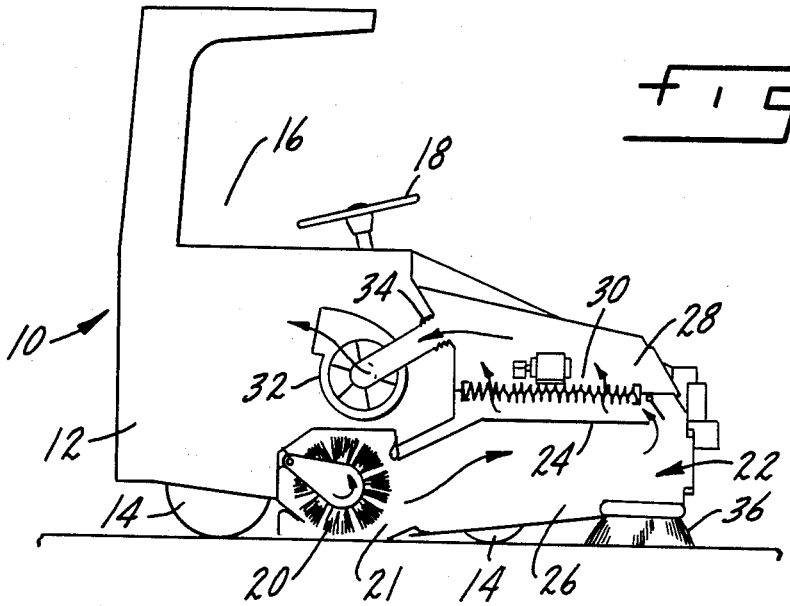
FIG. 1 is a schematic of a forward throw sweeper.

In FIG. 1, a sweeper has been shown in outline generally at 10 with a frame 12 on wheels 14 and an engine, not shown, so that it is self-propelled in the usual manner. It is a rider type unit with the operator having a seat or compartment 16 and various controls 18.

A main brush 20 is disposed laterally across the unit and rotates counterclockwise in FIG. 1 so that it propels debris forwardly through an inlet opening 21 into a trash bin or hopper 22 which may be a low dump or high dump unit. A baffle 24 generally divides the hopper into a lower trash compartment 26 and an upper filter compartment 28 which has a suitable filter, diagrammatically indicated at 30, which may be of the pleated paper variety. A vacuum fan 32 of any suitable type exhausts air from the trash hopper through a suitable connection 34 which, in this case, is shown at a point remote from the inlet 21 for the hopper.

The unit is also shown with a side brush 36 often referred to as a gutter brush which is rotated so as to move trash and debris from the side to in front of the unit so that the main brush 20 will then throw the debris into the hopper.

Such a sweeper is very effective in sweeping sand and other dense and heavy debris off of a floor or other surface to be cleaned, but problems have been encountered in the past in sweeping up light debris, such as paper, dry leaves and the like. Such light debris is thrown forward, but the air resistance tends to stop such material so that it piles up near the inlet or opening 21 while the heavier material will be propelled forwardly into the front of the hopper. The result of the light material piling up in the hopper inlet is that the hopper will become blocked off before it is full or loaded.

The vacuum fan 32 is conventionally used to create a vacuum in the hopper so that the dust that is stirred up or created by the main brush 20 draws air in under the side skirts and through the hopper inlet 21 so that the dust will not escape. The dusty air is pulled through the filter 30 by the fan and then exhausted to the atmosphere.

The present invention solves the problem of loading the light debris, when it is encountered, by speeding up the operation of the main brush and/or the vacuum fan for the time that light debris is being swept so that the light debris does not block the hopper inlet. The speed of the main brush 20 is normally set for what is optimum sweeping of the heavy material, i.e. sand, consistent with maximum brush life and what will stir up a minimum of dust. Speeding up the operation of the main brush 20 and the fan 32 on occasion will fully or adequately carry the light material, such as paper, dry leaves, and the like, forwardly into the hopper and prevent the inlet 21 from being prematurely clogged. The unit thus may be characterized as a two-speed unit, a normal speed which might be characterized as low speed and a high speed for loading the light debris. In a given unit, representative values are as follows:

| | LOW SPEED | HIGH SPEED |
|---|---|---|
| Engine | 2200 RPM | 2750 RPM |
| Main Brush | 415 RPM | 500 RPM |
| Fan | 410 CFM | 510 CFM |

Figure 2:
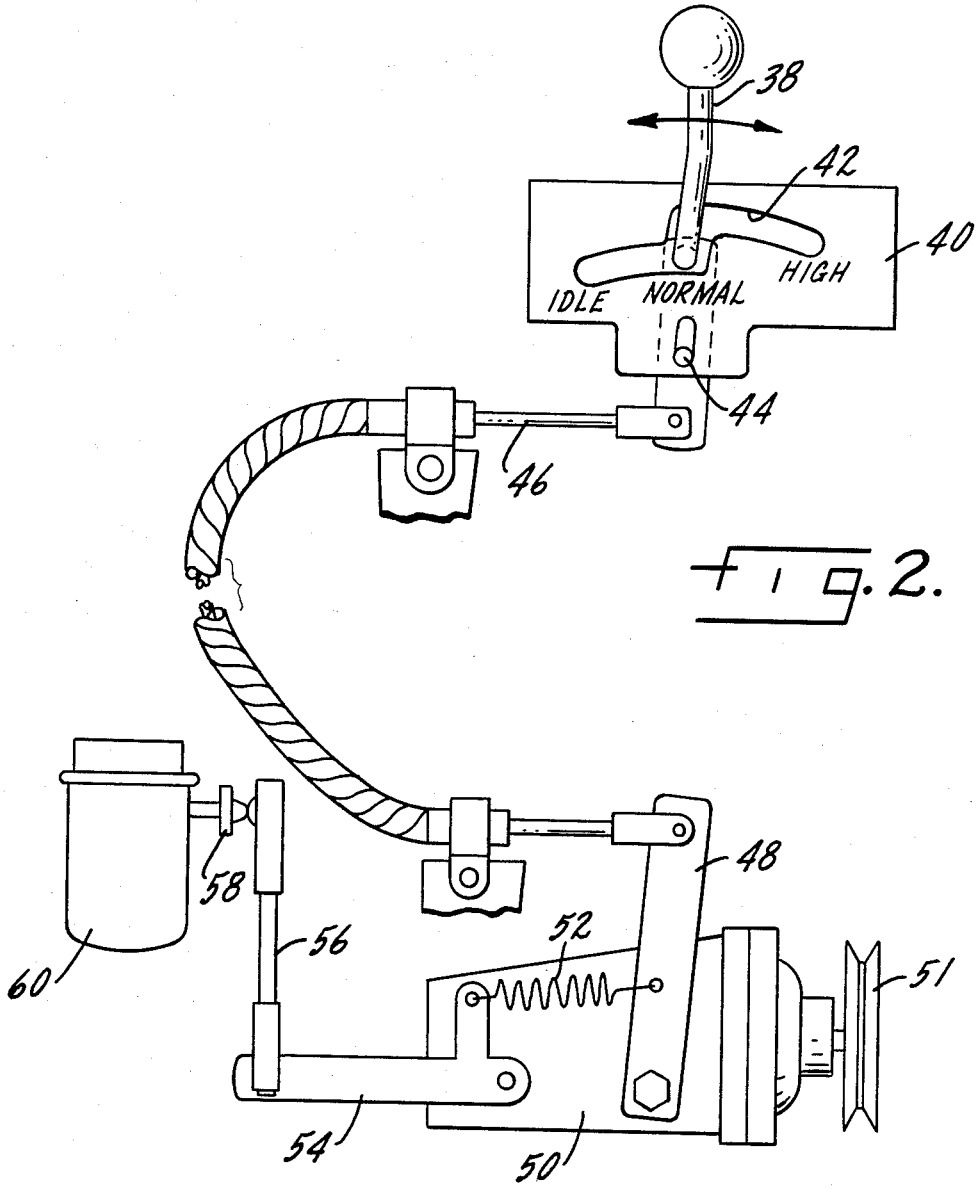
FIG. 2 is a schematic of a speed control.

A representative and diagrammatic two-speed control has been shown in FIG. 2 in which a control lever 38 for the operator has a detent plate 40 with a three position cam track 42 and a pivot 44 for the lever with a push-pull cable 46 connected to the other end. The control lever is movable between "idle" and "normal" positions but must be manually raised before it can be pushed forward to "high", the pivot 44 being in a slot so that it also may be raised. The lever may be spring biased downwardly by a light spring to assist gravity as a safety to prevent the operator from inadvertently "going into high", if that is found desirable. The control cable 46 in turn operates a lever 48 on a governor 50 which is belt driven from the engine crankshaft by a belt pulley 51. Lever 48 is connected by a spring 52 to a bell crank or throttle control arm 54 on the governor which, through a throttle control link 56, is connected to a throttle control lever 58 on the carburetor 60. The arrangement in FIG. 2 is diagrammatic and is only intended to illustrate the principle.

The governor, carburetor and the linkage connecting them may be conventional and are well known to those familiar with industrial engines.

Engine governors are available which do not operate on traditional mechanical principles but instead are electronic. They normally employ a sensor which detects engine speed and converts it into a signal. This is processed into a suitable signal to supply to a servomechanism that opens and closes the throttle in response to engine speed variations, thereby maintaining a desirable engine speed. Such governors would be applicable or usable with or in this invention and are intended to fall within the scope of the present disclosure, but will not be described in detail.

The invention may also be used with a sweeper having a diesel engine which customarily has a speed governor built into its fuel pump, with a lever on the pump housing for controlling engine speed. This lever is comparable in function and operation to the lever 48 of FIG. 2 and a similar control such as that designated 40 in FIG. 2 can be applied or used with or in the invention.

The sweeper may have a conventional hydrostatic transmission in the traction drive with a variable displacement reversible piston pump coupled directly to the engine which supplies a fixed displacement hydraulic motor on the drive wheel. Such a unit is conventionally steered with travel speed controlled by a conventional heel-and-toe foot pedal. The engine is operated at full governed speed at all times with the travel speed being controlled from 0 to maximum forward and reverse by the control pedal, all of which is conventional.

Figure 3:
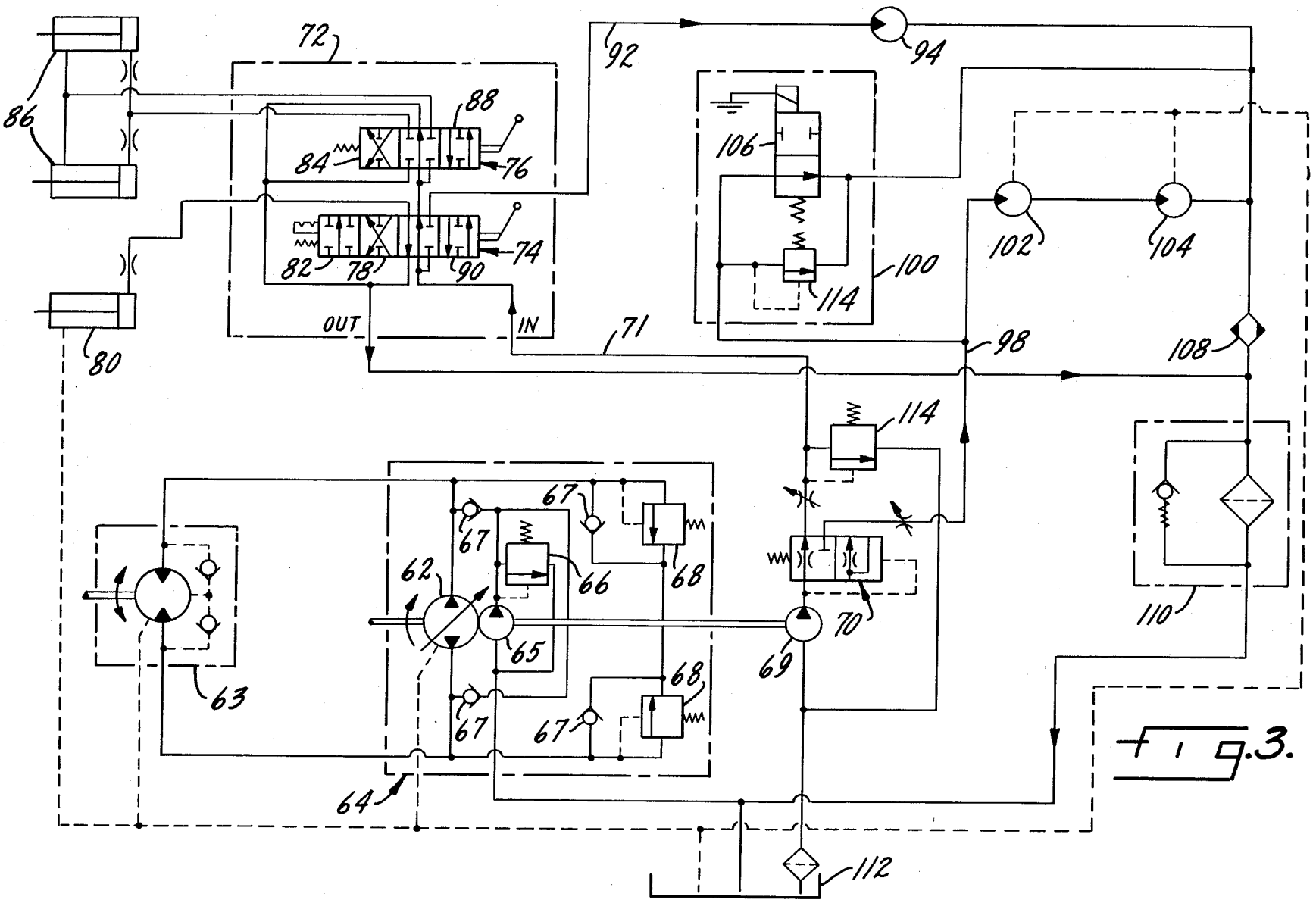
FIG. 3 is a hydraulic circuit for the unit.

In the hydraulic circuit diagram in FIG. 3, a variable displacement reversible pump 62 driven by the engine is connected by a closed loop circuit to a fixed displacement motor 63 on the rear drive wheel 14 in a conventional manner. The entire unit 64 as shown enclosed by phantom lines may be a conventional commercially available hydrostatic transmission pump unit, comprised of variable displacement reversible pump 62, charge pump 65 with associated low pressure relief valve 66, four check valves 67 and two high pressure relief valves 68. A fixed displacement pump 69 is also driven by the engine and supplies hydraulic fluid for the various other components. Fluid from pump 69 passes through a priority flow control valve 70 to be explained later, through line 71 to a main control valve unit 72 which has a first manually operated valve 74 shown in the neutral position where it supplies fluid to a second manually operated valve 76. In position 78, first valve 74 operates a hopper lift cylinder 80. Position 82 on the first valve will hold the hopper in lifted position and also pass fluid through to valve 76. When the second valve 76 is in position 84, it supplies fluid to a pair of hopper rollout cylinders 86 if the unit is a high dump system. Position 88 on the second valve reverses the rollout cylinders 86 and causes the hopper to roll back. Position 90 on the first valve sends fluid through a line 92 to a motor 94 that operates the side brush 36. Neutral position as shown on valve 74 will shut off the side brush motor.

The priority flow control valve 70 operates in a conventional manner. It serves to direct a constant flow of fluid though line 71 to side brush motor 94 regardless of excess flow from pump 69 within the limits of the device. The excess fluid is directed through line 98 to main brush motor 102 which operates main brush 20 shown in FIG. 1 and to vacuum fan motor 104 which operates vacuum fan 32 shown in FIG. 1. Thus when engine speed is increased, the speed and fluid output of pump 69 will increase. The flow through line 71 will remain constant and the increased flow will pass through line 98 and increase the speed of main brush motor 102 and vacuum fan motor 104. A selector valve 100 is in parallel with main brush motor 102 and vacuum fan motor 104. The selector valve 100 may include a solenoid operated valve 106 which, when the solenoid is operated, moves valve 106 to blocking position so that the main brush motor 102 and vacuum fan motor 104 are operated. The solenoid may be controlled, for example, by a toggle switch on the dashboard, operated by the driver, to start or stop the main brush and vacuum fan. A cooler 108 and filter 110 in the return line as well as the reservoir or sump 112 are shown and may be conventional. Two high pressure relief valves 114 may be installed for protection against excess pressure in lines 71 and 98.

The use, operation and function of the invention are as follows:

The invention has been disclosed in connection with a forward throw sweeper in which material is propelled by a brush through a rear opening in a hopper. The hopper is divided into two chambers, the lower chamber for debris and the upper chamber for a filter unit. A vacuum fan is connected to the hopper so as to create a partial vacuum therein so that dust created by the brush will be kept inside the sweeper by atmospheric air drawn in under the side skirts, etc., all of which may be conventional. Such a sweeper adequately handles heavy material, such as sand and the like. But light material such as leaves, paper, etc. resists being thrown by the brush and will pile up in the hopper inlet.

In the present arrangement, when light debris is encountered, the main brush and vacuum fan are speeded up. This gives the main brush more throw and provides more vacuum from the vacuum fan. The result is that paper and dry leaves that might otherwise clog the hopper inlet will be carried forward in the hopper.

The speed of the side brush 36 is normally set to move debris from alongside the sweeper into the path of the main brush. The speed is selected to dislodge the material in front of the side brush and move it under the main body of the sweeper but not fast enough to throw the debris completely across the path of the sweeper. It is desirable that the speed of the side brush be held constant regardless of the speed of the main brush and vacuum fan to avoid throwing debris across the path of the sweeper and outside the path of the main brush.

The operator of the sweeper may be provided with a speed control, as in FIG. 2, which allows him to operate the sweeping brush and vacuum fan at two speeds. The lower brush speed is chosen for optimum sweeping of sand, for example. This gives maximum brush life and stirs up a minimum of dust. The fan speed which is associated with this brush speed gives adequate dust control and requires a minimum of power to run the fan. This is an economical setting which will be used most of the time in normal sweeping. The higher speed setting increases the brush speed and air flow volume through the hopper to a point where the amount of light debris loaded in the hopper is acceptable. The increased brush wear and fan power consumption can be tolerated because sweeping light debris is usually a relatively small part of the total duty cycle of the sweeper.

When the brush and fan are put in the second or higher speed, however, the side brush maintains its speed because of the inclusion of the priority flow control valve in the circuit.

In the disclosed hydraulic circuit, the connections for hydraulically raising the hopper when it needs to be dumped, then rolling it out for dumping into a receptacle, are also shown. During these operations, all of the fluid in line 71 is diverted from, driving the side brush and used for the lift and dump functions.

Operating the engine at either of two speeds will not affect the operator's ability to control the travel speed of the sweeper. If the engine is running at "normal" and the sweeper is moving at a certain speed and the driver changes the engine speed to "high", the sweeper might tend to increase its speed. But the operator can maintain his previous speed by making a compensating change in the setting of the speed control pedal and continue his work using that setting. Thus, the addition of a second engine speed does not need to increase the travel speed of the sweeper.

One of the main advantages of the present invention is that it increases loading of light debris without introducing major added components, such as a compactor plate, an auxiliary blower, etc., all of which are expensive.

Figure 4:
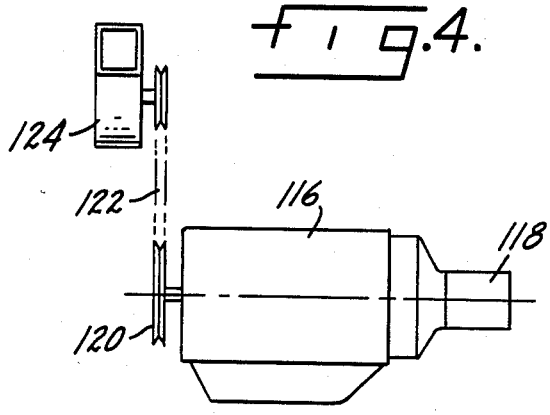
FIG. 4 is a schematic of a variant form.

While an engine has been referred to, it should be understood that it may be a gasoline, LP or diesel engine. In fact, any suitable type of power drive may be used. Another approach might be to have the vacuum fan 32 driven directly by the engine, for example, through a belt with the main brush, side brush, hopper lifting and dump cylinders, etc. all operated by a hydraulic circuit. Two-speed engine control could still be used. For example in FIG. 4, an engine has been indicated generally at 116 driving a hydraulic pump 118 which may be the same as pump 62 in FIG. 3. A pulley 120 drives a belt 122 which in turn drives the vacuum fan 124. The hydraulic circuit operated by pump 118 may be the same as what is shown in FIG. 3 except that it would not include the vacuum fan motor 104.

The invention can also be applied to a sweeper in which the side brush is driven by an electric motor off of a battery. In that case, the engine which drives the main brush and vacuum fan could be operated at two speeds without affecting the speed of the side brush.

Figure 5:
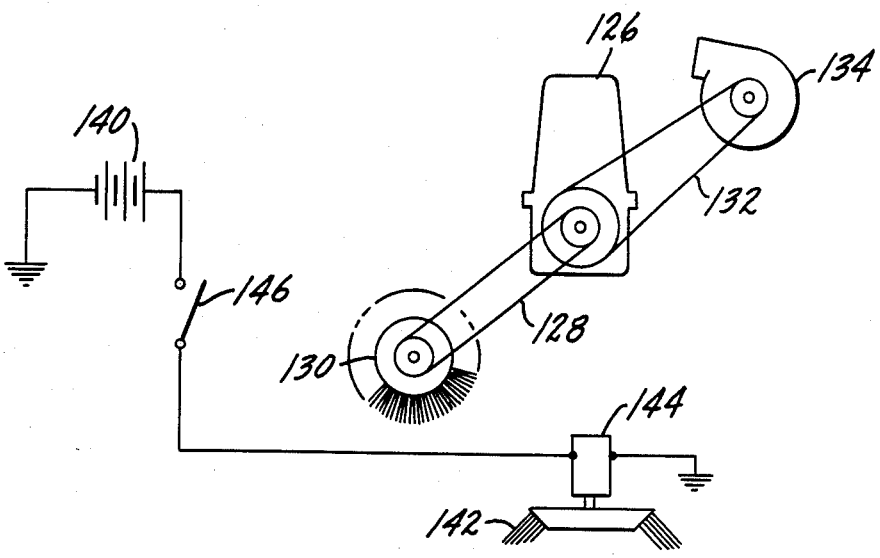
FIG. 5 is a schematic of a further variant.

As mentioned previously, the sweeper could have its main brush and vacuum fna belt driven by the engine and a side brush driven by an electric motor. For example, as shown in FIG. 5, an engine 126 is indicated as having a belt drive 128 to a main brush 130 and a similar belt drive 132 to the vacuum fan 134 so that these may vary in speed as the engine speed varies. Variable engine speeds may be obtained by controlling the engine governor as shown in FIG. 2 herein. The side or gutter brush 142 is driven at a constant speed by an electric motor 144 which is connected to a battery 140 through a suitable switch 146.

While the invention has been referred to in connection with two speeds, it should be understood that more than two speeds might be used. In that sense, a variable range of speeds could be used although two is considered adequate.

There is another type of sweeper which is battery powered for indoor use where engines are not favored. In that type of sweeper, electric motors drive the various components. And it will be understood that this two speed arrangement for the purposes indicated could be used on such a battery operated sweeper with two speed electric motor controls applied to the main brush and vacuum fan motors.

Figure 6:
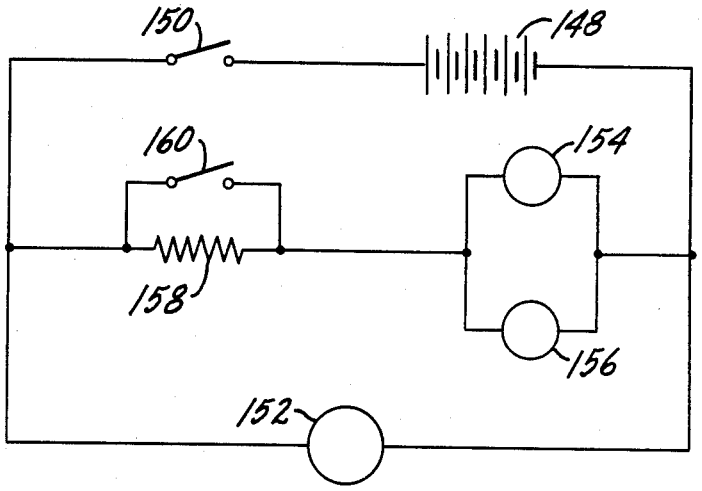
FIG. 6 is a schematic of a further variant.

For example, in FIG. 6, a battery 148 with a switch 150 has the motor 152 for the side brush connected in parallel with the motors 154 for the main brush and 156 for the vacuum fan. A suitable resistance 158 or the like may be placed in series with the main brush and vacuum fan motors 154 and 156 and shorted out by a switch 160. With the switch open, the resistance 158 would be in series with the main brush and vacuum fan motor so that they would run slower and would speed up when switch 160 is closed without affecting the speed of the side brush motor 152. Also, the vacuum fan has been shown as connected to the hopper at a point remote from the debris inlet which is considered an advantage since the air current created by the fan will tend to draw light material farther into the hopper. There is a line of sweepers that draw this air from directly above the sweeping brush and the two speed approach outlined above may be used on such an arrangement although it is considered more desirable to draw the air fully through the hopper in loading light debris.

Whereas the FIG. 3 form of hydraulic circuit uses a single pump with a flow divider for driving the various components so that the side or gutter brush has a constant speed and the main brush and fan have variable speeds, it should be understood that the same result may be accomplished by using more than one pump. For example, a unit might have a separate variable displacement pump for the main brush and fan with the side or gutter brush, dumping cylinders and controls, etc. being driven by a separate fixed displacement pump. But the arrangement shown in FIG. 3 is considered more desirable because a separate variable displacement pump would be more expensive.

Also, while the invention has only been shown in connection with a forward throw sweeper in FIG. 1, it should be understood that it is just as applicable to an over-the-top sweeper with a rear hopper where, even though loading light debris may not be a problem, other advantages could be obtained.

In addition, in either a forward throw or an over-the-top sweeper, the invention might be used for high speed patrol sweeping of large areas, such as in parking lots having only occasional light debris. It could also be used to sweep heavy accumulations of any debris, such as sand and the like, without slowing down as much as a sweeper with a normal speed brush. It will also be effective in sweeping fine dust, such as starch, talc and the like, better than the machine with standard air and brush speeds. Further, it will give a better polish or luster to a fine floor, if that is considered desirable. As well, the increased air flow should give better dust control in any type of sweeping operation.

Of particular advantage is the fact that the sweeper may and will be operating much, if not most, of the time at lower noise levels, lower emission levels and lower fuel consumption.

Whereas the preferred form and several variations of the invention have been shown and suggested, it should be understood that suitable additional modifications, changes, substitutions and alterations may be made without departing from the invention's fundamental theme.

We claim:

1. A power-driven sweeper having two elements for moving material, such as dirt, paper, etc. from a surface to be cleaned into an opening of a generally enclosed trash receiving hopper, one element being a main horizontal rotary brush adapted to be rotated opposite the hopper opening and the other being a vacuum fan constructed and arranged to exhaust air from the enclosed hopper so that dust created by the main brush will tend to be drawn into the trash hopper, means for rotating the brush and operating the vacuum fan the majority of the time that the sweeper is in use at what may be considered a normal operating speed, and means for increasing the speed of operation of at least one of the elements from time to time so as to cuase difficult-to-sweep material to be moved farther into the trash hopper.

2. The structure of claim 1 further characterized by and including means for increasing the speed of both the main brush and the vacuum fan.

3. A power-driven sweeper having a main horizontal rotary brush adapted to be rotated to propel material, such as sand, dirt, paper, etc. from a surface to be cleaned into an opening of a generally enclosed trash receiving hopper with a vacuum fan constructed and arranged to exhaust air from the enclosed hopper so that dust created by the main brush will tend to be drawn into the trash hopper, means for rotating the brush and operating the vacuum fan the majority of the time that the sweeper is in use at what may be considered a normal operating speed that is related to brush wear characteristics to insure adequate brush life, and means for increasing both the speed of brush rotation and the speed of the fan from time to time so as to cause lightweight material, such as paper, dry leaves and the like to be moved farther into the trash hopper.

4. The structure of claim 3 further characterized in that the sweeper has a power-driven rotary side brush that is arranged to move material from alongside the sweeper into the path of the main brush, and further including means for maintaining the speed, of rotation of the side brush substantially constant when the speeds of the main brush and vacuum fan are increased.

5. The structure of claim 3 further characterized in that the main brush and vacuum fan are operated at just two speeds, the normal speed and an increased speed.

6. The structure of claim 3 further characterized by and including means for exhausting the air with the vacuum fan from the trash hopper at a point remote from the hopper opening and main brush.

7. The structure of claim 1 further characterized in that the sweeper is powered by an engine with the main brush and vacuum fan being driven by the engine, and further including means for varying the speed of the engine to vary the speed of the main brush and vacuum fan.

8. The structure of claim 7 further characterized in that the main brush and vacuum fan are hydraulically driven.

9. The structure of claim 7 further characterized in that the main brush and vacuum fan are electrically driven.

10. The structure of claim 7 further characterized in that the main brush and vacuum fan are belt driven by the engine.

11. In a direct forward throw sweeper, a self-propelled frame, power means on the frame for propelling it, a main horizontal rotary brush on the frame adapted to engage and throw material, such as sand, dirt, paper, dry leaves, etc. from a surface to be cleaned, a generally enclosed trash receiving hopper on the frame forward of the main brush and having a trash receiving opening in the rear area thereof generally opposite the main brush, a vacuum fan connected to the hopper to exhaust air therefrom so that dust created by the main brush will tend to be drawn into the hopper, and means for operating the main brush and vacuum fan from the power means at at least two speeds, a lower speed that is related to brush wear characteristics to insure adequate brush life, and at least one higher speed to cause lighter material such as paper, dry leaves and the like to be moved farther into the trash hopper.

12. The structure of claim 11 further characterized by and including a rotary side brush on the frame driven by the power means and arranged to move material from alongside the sweeper into the path of the main brush, and means for not increasing the speed of the side brush when the speeds of the main brush and vacuum fan are varied.

13. The structure of claim 11 further characterized by and including means for operating the main brush and vacuum fan at only two speeds.

14. The structure of claim 11 further characterized in that the vacuum fan is connected to exhaust air from the hopper at a point remote from the opening in the rear area thereof.

15. The structure of claim 11 further characterized in that the power means is an internal combustion engine, the main brush and vacuum fan being driven by the engine.

16. A hydraulic circuit including a main power source which drives a hydraulic pump for operating a sweeper having a main horizontal rotary brush driven by a hydraulic motor adapted to propel material from a surface to be cleaned into an opening of a generally enclosed trash receiving hopper and a side brush driven by a hydraulic motor arranged to move material from alongside the sweeper into the path of the main brush with a vacuum fan to exhaust air from the hopper so that dust created by the main brush will tend to be drawn into the hopper, the circuit including a variable flow hydraulic circuit connected between the main pump and the main brush motor to vary the speed of the main brush so that the main brush speed may be increased to cause lighter weight material such as paper, dry leaves and the like to be moved farther into the trash hopper, a separate hydraulic circuit connected to the side brush motor so that the speed of the side brush will not increase when the speed of the main brush is increased, and a drive for the vacuum fan that causes it to increase in speed when the main brush increases in speed so that the vacuum fan tends to create a greater airflow through the hopper when the main brush speed increases, thereby tending to cause the lighter weight material to be moved farther into the trash hopper.

17. The structure of claim 16 further characterized in that the vacuum fan is driven by a hydraulic motor which is in the variable flow hydraulic circuit between the main pump and the main brush motor so that the vacuum fan automatically increases in speed with the main brush.

18. The structure of claim 16 further characterized in that the vacuum fan is connected to exhaust air from the hopper at a point remote from the opening in the hopper to receive trash.

19. A hydraulic circuit for operating a power operated sweeper including a main power source and a pump driven thereby, the sweeper having a main horizontal rotary brush driven by a hydraulic motor adapted to propel material from a surface to be cleaned into an opening of a generally enclosed trash receiving hopper with a vacuum fan driven by a hydraulic motor to exhaust air from the hopper so that dust created by the main brush will tend to be drawn into the hopper and a side brush driven by a hydraulic motor arranged to move material from alongside the sweeper into the path of the main brush, including a variable flow hydraulic circuit connected between the pump and the main brush motor and the vacuum fan motor to vary the speed of the main brush and fan so that, from time to time, the speed of the main brush and fan may be increased to cause lightweight material, such as paper, dry leaves and the like, to be moved farther into the trash hopper, and a separate circuit connected between the pump and the side brush motor so that the speed of rotation of the side brush motor will not increase when the speed of the main brush and vacuum fan are increased.

20. The structure of claim 19 further characterized in that the separate circuit is a fixed flow circuit so that the speed of rotation of the side brush will remain substantially constant when the speed of the main brush and vacuum fan are increased.

21. In a power operated sweeper, a frame, an engine on the frame for operating the sweeper, a main horizontal rotary brush on the frame driven by the engine and adapted to propel material from the surface to be cleaned, a trash receiving hopper on the frame with an opening opposite the main brush to receive material propelled by the main brush, a vacuum fan on the frame driven by the engine to exhaust air from the hopper so that dust created by the main brush will tend to be drawn into the hopper, a side brush on the frame driven by the engine arranged to move material from alongside the sweeper into the path of the main brush, mechanical connections for driving both the main brush and the vacuum fan from the engine, means for increasing the speed of the engine and therefore the speeds of the main brush and vacuum fan from time to time to cause lightweight material such as paper, dry leaves and the like to be moved farther into the trash hopper, and an electrical circuit for driving the side brush from the engine by a motor and battery which does not increase the speed of the side brush when the speed of the main brush and vacuum fan are increased.

22. The structure of claim 21 further characterized in that the sweeper is self-propelled by the engine.

23. In a power operated sweeper, a frame, batteries on the frame for operating the sweeper, a main horizontal rotary brush and electric motor on the frame driven by the batteries and adapted to propel material from the surface to be cleaned, a trash receiving hopper on the frame with an opening opposite the main brush to receive material propelled by the main brush, a vacuum fan and electric motor on the frame driven by the batteries to exhaust air from the hopper so that dust created by the main brush will tend to be drawn into the hopper, a side brush and electric motor on the frame driven by the batteries arranged to move material from alongside the sweeper into the path of the main brush, electrical circuits for driving the electric motors for the main brush, the vacuum fan and the side brush from the batteries, and means for increasing both the speed of the main brush and the fan so as to cause lighter material, such as paper, dry leaves and the like to be moved farther into the trash hopper without increasing the speed of the side brush.

24. The structure of claim 23 further characterized in that the sweeper is self-propelled by means that are powered by the batteries.

25. The structure of claim 16 further characterized in that the vacuum fan is belt driven directly from the main power source.

26. The structure of claim 21 further characterized in that the mechanical connections for driving both the main brush and vacuum fan are belts.

27. In a sweeper, a self-propelled frame, power means on the frame, a main horizontal rotary brush on the frame adapted to engage and throw material, such as sand, dirt, paper, dry leaves, etc. from a surface to be cleaned, a generally enclosed trash receiving hopper on the frame adapted to receive debris propelled by the main brush, a vacuum fan connected to the hopper to exhaust air therefrom so that dust created by the main brush will tend to be drawn into the hopper, and means for operating the main brush and vacuum fan from the power means at at least two speeds, a lower speed that is used the majority of the time that the sweeper is in use and is related to brush wear characteristics to insure adequate brush life, and at least one higher speed from time to time on a limited basis.

* * * * *